US006000212A

United States Patent [19]

Kolaczkowski et al.

[11] Patent Number: 6,000,212

[45] Date of Patent: Dec. 14, 1999

[54] CATALYTIC COMBUSTION CHAMBER WITH PILOT STAGE AND A METHOD OF OPERATION THEREOF

[75] Inventors: Stanislaw I. Kolaczkowski; Serpil Awdry, both of Bath; John L. Scott-Scott, Nuneaton, all of United Kingdom

[73] Assignee: Rolls-Royce plc, London, United Kingdom

[21] Appl. No.: 08/850,745

[22] Filed: May 2, 1997

[30] Foreign Application Priority Data

May 3, 1996 [GB] United Kingdom ..... 9609317

[51] Int. Cl.[6] ..... F23R 3/40; F23R 3/34

[52] U.S. Cl. ..... 60/39.06; 60/723; 60/733; 431/7

[58] Field of Search ..... 60/39.06, 723, 60/733; 431/7

[56] References Cited

U.S. PATENT DOCUMENTS

| | | | |
|---|---|---|---|
| 4,375,949 | 3/1983 | Salooja | 431/7 |
| 4,534,165 | 8/1985 | Davis et al. . | |
| 4,926,645 | 5/1990 | Iwai et al. . | |

FOREIGN PATENT DOCUMENTS

| | | | |
|---|---|---|---|
| 259 758 | 3/1988 | European Pat. Off. . | |
| 58-179730 | 10/1983 | Japan . | |
| 59-007722 | 1/1984 | Japan | 60/723 |
| 9009 | 2/1984 | Japan | 431/7 |
| 59-180220 | 10/1984 | Japan | 60/723 |
| 61-195215 | 8/1986 | Japan | 60/723 |
| WO 93 25852 | 12/1993 | United Kingdom . | |
| 2 295 008 | 5/1996 | United Kingdom . | |

*Primary Examiner*—Ted Kim

*Attorney, Agent, or Firm*—W. Warren Taltavull; Farkas & Manelli PLLC

[57] ABSTRACT

A catalytic combustion chamber is provided with at least two catalytic combustion zones arranged in flow series. In a first mode of operation fuel is supplied from first fuel injectors, positioned upstream of the first catalytic combustion zone, into the catalytic combustion chamber and is burnt in the first catalytic combustion zone in order to preheat the subsequent catalytic combustion zones. In the second mode of operation the supply of fuel to the first fuel injectors is reduced and fuel is supplied from second fuel injectors positioned between the first catalytic combustion zone and the second catalytic combustion zone into the space between the first catalytic combustion zone and the second catalytic combustion zone. This prevents the first catalytic zone becoming overheated, and reduces the possibility of the second and third catalytic combustion zones becoming overheated and allows the optimum catalyst to be selected for the first catalytic combustion zone.

7 Claims, 1 Drawing Sheet

CATALYTIC COMBUSTION CHAMBER WITH PILOT STAGE AND A METHOD OF OPERATION THEREOF

THE FIELD OF THE INVENTION

The present invention relates to combustion chambers, in particular to catalytic combustion chambers for gas turbine engines.

BACKGROUND OF THE INVENTION

The use of catalytic combustion chambers in gas turbine engines is a desirable aim, because of the benefits in the reductions of combustion chamber emissions, particularly nitrogen oxides (NOx). The reduction in NOx is due to the lower operating temperatures and the use of much weaker fuel and air ratios than conventional combustion chambers.

In catalytic combustion chambers it is known to use ceramic, or metallic, honeycomb monoliths which are coated with a suitable catalyst. It is also known to use honeycomb monoliths which contain a suitable catalyst or are formed from a suitable catalyst.

It is also known to arrange several of the honeycomb monoliths in flow series such that there is a progressive reduction in the cross-sectional area of the cells of the honeycomb from one honeycomb monolith to an adjacent honeycomb monolith, in the direction of flow. The honeycomb cell size may vary and the cross-sectional area for flow may vary. The smaller honeycomb cell size has the effect of providing a high geometric surface area per unit volume, which may increase the available catalyst area per unit volume, which in turn may increase the catalytic reaction rate per unit volume and hence reduce emissions of unburned hydrocarbons.

In catalytic combustion chambers there is an optimum temperature range at which catalytic reaction on the catalyst will occur. At temperatures below the optimum temperature range the rate of catalytic reaction will be very low, whilst at temperatures above the optimum temperature range the catalytic reaction diminishes due to damage to the catalyst, for example because of sintering, or phase transition e.g. palladium oxide changes to palladium, and lose its activity. However the catalytic activity of the catalyst is never likely to be zero. Different catalysts have different optimum temperature ranges. Thus some catalysts have good lower temperature capabilities, i.e. will operate at relatively low temperatures around 350° C. to 400° C., but have poor higher temperature capabilities. Other catalysts have good higher temperature capabilities, but poor lower temperature capabilities. Also a gas turbine engine operates over a wide operating range. Currently there is no known catalyst which has an acceptable level of activity across the entire operating temperature range of a gas turbine engine combustion chamber. This makes it necessary to have a series of catalyst coated honeycomb monoliths arranged in series in a combustion chamber, with catalysts having good lower temperature capabilities on the first honeycomb monolith and catalysts having progressively increasing higher temperature capabilities such that the catalyst on the last honeycomb monolith has the best higher temperature capability. Thus there may be two or more catalyst coated honeycomb monoliths arranged in flow series in a catalytic combustion chamber. Usually it is arranged that the temperature downstream of the last catalyst coated honeycomb monolith is sufficient to support homogeneous gas phase reactions.

In catalytic combustion chambers hydrocarbon fuel and air are mixed and supplied to the catalyst coated honeycomb monoliths, or honeycomb monoliths formed from, or containing catalyst. The hydrocarbon fuel and air mixture diffuses to the catalyst coated surfaces of the honeycomb monoliths and reacts on the active sites, at and within the surface.

In one known catalytic combustion chamber a pilot combustor, or pre-burner, is provided to burn some of the fuel to preheat the first catalytic combustion zone to the optimum temperature range. A main fuel injector positioned upstream of the first catalytic combustion zone, is provided to supply fuel to the first catalytic combustion zone. The second and subsequent catalytic combustion zones receive unburned fuel from the first catalytic combustion zone.

It has been proposed to provide a catalytic combustion chamber with a pilot combustor, or pre-burner, to burn some of the fuel to preheat the first catalytic combustion zone to the optimum temperature range. A main fuel injector, positioned upstream of the first catalytic combustion zone, is provided to supply fuel to the first catalytic combustion zone. An additional fuel injector, positioned between the first and second catalytic combustion zones, is provided to supply additional fuel to the second catalytic combustion zone.

A problem associated with catalytic combustion chambers is that there is a possibility that one or more of the catalytic combustion zones, may become overheated leading to deactivation of the catalyst. It is also necessary to ensure that the temperature downstream of the last catalytic combustion zone is sufficiently high to maintain homogeneous gas phase reactions.

SUMMARY OF THE INVENTION

The present invention seeks to provide a method of operating a catalytic combustion chamber which overcomes the above mentioned problem.

Accordingly the present invention provides a method of operating a catalytic combustion chamber, the catalytic combustion chamber comprising a first catalytic combustion zone and at least a second catalytic combustion zone spaced from and positioned downstream of the first catalytic combustion zone, means to supply air to the first catalytic combustion zone, means to supply fuel to the first catalytic combustion zone and means to supply fuel to the space between the first and second catalytic combustion zones, the method comprising:

(a) supplying fuel to the first catalytic combustion zone in a first mode of operation, (b) reducing the supply of fuel to the first catalytic combustion zone and supplying fuel to the space between the first and second catalytic combustion zones in a second mode of operation.

The catalytic combustion chamber may comprise a third catalytic combustion zone spaced from and positioned downstream of the second combustion zone.

There may be means to supply fuel to the space between the second and third catalytic combustion zones.

The supply of fuel to the space between the first and second catalytic combustion zones may be reduced and fuel is supplied to the space between the second and third catalytic combustion zones in a third mode of operation.

The supply of fuel to the first catalytic zone may be reduced to 10% or less of the total fuel supplied to the combustion chamber and 90% or more of the total fuel supplied to the combustion chamber is supplied to the second catalytic combustion zone.

The supply of fuel to the first catalytic zone may be terminated and all the fuel is supplied to the second catalytic combustion zone.

The advantage of the present invention is that it prevents overheating of the catalyst at least in the first catalytic combustion zone. Also it allows catalysts with very low lower temperature capabilities to be used to enhance the light off characteristics of the combustion chamber.

The present invention also provides a catalytic combustion chamber comprising a first catalytic combustion zone and at least a second catalytic combustion zone spaced from and positioned downstream of the first catalytic combustion zone, means to supply air to the first catalytic combustion zone, first fuel injector means to supply fuel to the first catalytic combustion zone, second fuel injector means to supply fuel to the space between the first and second catalytic combustion zones, valve means to control the supply of fuel to the first fuel injector means and to control the supply of fuel to the second fuel injector means such that the valve means switches between a first position which allows the supply of fuel to the first catalytic combustion zone and a second position which reduces the supply of fuel to the first catalytic combustion zone and supplies fuel to the space between the first and second catalytic combustion zones.

The catalytic combustion chamber may comprise a third catalytic combustion zone spaced from and positioned downstream of the second combustion zone.

There may be third fuel injector means to supply fuel to the space between the second and third catalytic combustion zones.

The valve means may comprise a first valve to control the supply of fuel to the first fuel injector means and a second valve to control the supply of fuel to the second fuel injector means.

Preferably the first catalytic combustion zone comprises a catalyst suitable for catalysing combustion reactions at a first temperature range, the second catalytic combustion zone comprises a catalyst suitable for catalysing combustion reactions at a second temperature range and the first temperature range is at a lower temperature than the second temperature range. Alternatively the first and second catalytic combustion zones may comprise catalysts for catalysing combustion reactions at substantially the same temperature range.

The third catalytic combustion zone may comprise a catalyst suitable for catalysing combustion reactions at a third temperature range, and the third temperature range is at a higher temperature than the second temperature range.

Preferably in the second position the valve means terminates the supply of fuel to the first catalytic zone and all the fuel is supplied to the second catalytic combustion zone.

Each catalytic combustion zone comprises a catalyst coated ceramic honeycomb monolith, a catalyst coated metallic honeycomb matrix, a honeycomb monolith formed from catalyst material or a honeycomb monolith containing catalyst material.

The catalytic combustion chamber may be tubular or annular.

A pilot combustor may be arranged to preheat the first catalytic combustion zone.

BRIEF DESCRIPTION OF THE DRAWINGS

The present invention will be more fully described by way of example with reference to the accompanying drawings, in which.

DETAILED DESCRIPTION OF THE INVENTION

Figure 1:
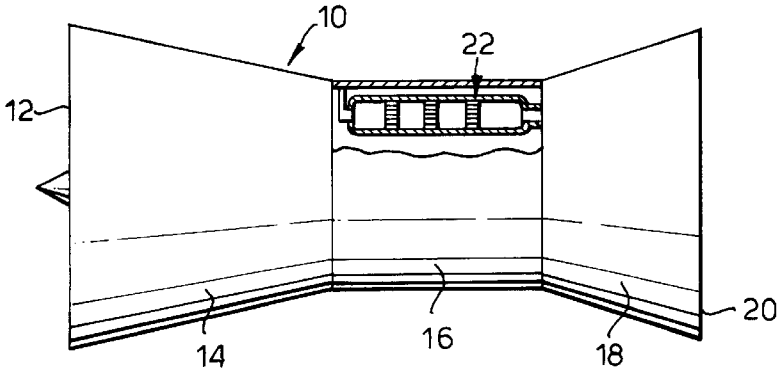
FIG. 1 is a partially cut-away view of a gas turbine engine having a catalytic combustion chamber.

A gas turbine engine 10, which is shown in FIG. 1, comprises in flow series an intake 12, a compressor section 14, a combustion section 16, a turbine section 18 and an exhaust 20. The gas turbine engine 10 operates conventionally in that air is compressed as it flows through the compressor section 14, and fuel is injected into the combustor section 16 and is burnt in the compressed air to provide hot gases which flow through and drive the turbines in the turbine section 18. The turbines in the turbine section 18 are arranged to drive the compressors in the compressor section 14 via shafts (not shown).

Figure 2:
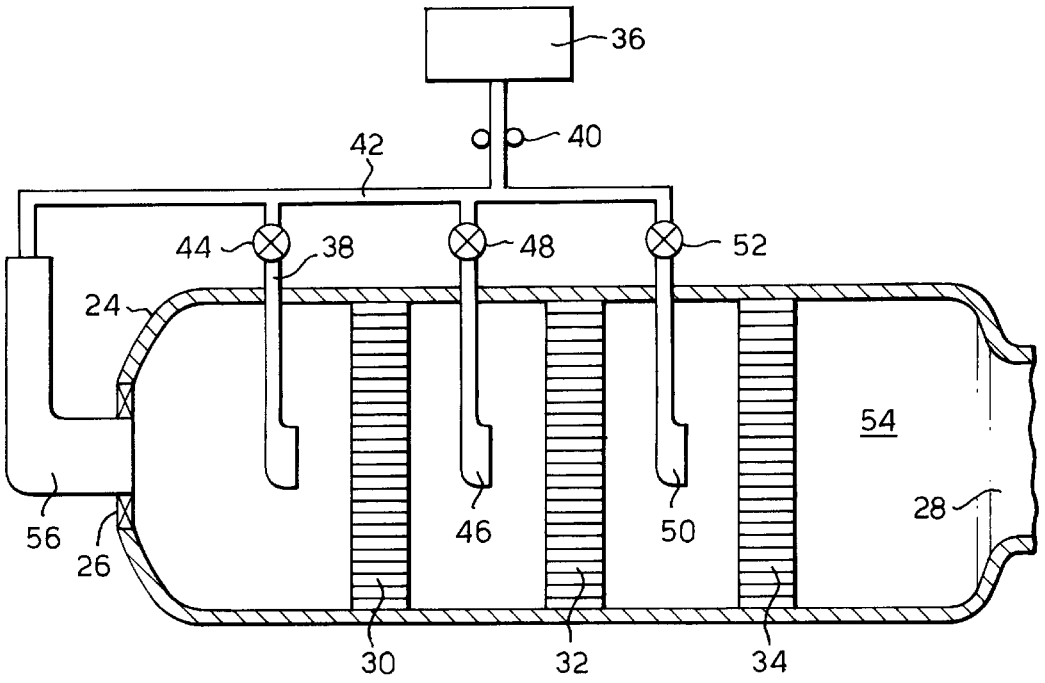
FIG. 2 is a cross-sectional view through the catalytic combustion chamber shown in FIG. 1.

The combustion section 16 comprises one or more catalytic combustion chambers 22 as shown more clearly in FIG. 2. The catalytic combustion chamber 22 shown in FIG. 2 is a tubular combustion chamber, and there are a plurality of the tubular combustion chambers arranged coaxially around the axis of the gas turbine engine 10, but it may be possible to use a single annular combustion chamber or other arrangements. The tubular catalytic combustion chamber 22 comprises an annular wall 24 which has an inlet 26 at its upstream end for the supply of compressed air, from the compressor section 14, into the tubular catalytic combustion chamber 22, and an outlet 28 at its downstream end for the delivery of hot gases produced in the combustion process from the tubular catalytic combustion chamber to the turbine section 18. The inlet 26 may be provided with swirl vanes, or other suitable mixing devices, to enable the fuel and air to be mixed thoroughly.

A first catalyst coated honeycomb monolith 30 is positioned at the upstream end of the tubular catalytic combustion chamber 22 and forms a first catalytic combustion zone. A second catalyst coated honeycomb monolith 32 is spaced from and positioned downstream of the first catalyst coated honeycomb monolith 30 and forms a second catalytic combustion zone. A third catalyst coated honeycomb monolith 34 is spaced from and positioned downstream of the second catalyst coated honeycomb monolith 32 and forms a third catalytic combustion zone.

The first catalytic coated honeycomb monolith 30, the first catalytic combustion zone, is coated with a catalyst which has a good lower temperature capability, that is it requires a relatively low lower temperature to enable the catalytic combustion reaction to occur at lower temperatures to enable heat to be generated to heat up the second catalyst coated honeycomb monolith 32. The second catalyst coated honeycomb monolith 32, the second catalytic combustion zone, is coated with a catalyst which has low temperature capability or intermediate temperature capability. The third catalyst coated honeycomb monolith 34, the third catalytic combustion zone, is coated with a catalyst which has good higher temperature capabilities, that is it has a relatively high higher temperature to enable the catalytic combustion reaction to occur at higher temperatures and is capable of withstanding much higher temperatures before it becomes deactivated.

A fuel supply 36 is provided to supply fuel to the tubular catalytic combustion chambers 22. The fuel supply 36 is arranged to supply fuel to a plurality of first fuel injectors 38, each one of which is positioned at the upstream end of one of the tubular catalytic combustion chambers 22. There may be more than one first fuel injector 38 for each tubular combustion chamber 22. The first fuel injectors 38 are arranged to inject fuel into the tubular catalytic combustion chambers 22 upstream of the first catalytic combustion zone, the first catalyst coated honeycomb monolith 30. The fuel supply is arranged to supply the fuel to the first fuel injectors 38 via a fuel pump 40, a fuel pipe 42 and a valve or valves 44. It may be necessary to provide mixing devices to ensure that there is intimate mixing of the fuel and air before before the fuel reaches the first catalytic combustion zone 30.

The fuel supply 36 is also arranged to supply fuel to a plurality of second fuel injectors 46. There may be more than one second fuel injector 46 for each tubular combustion chamber 22. The second fuel injectors 46 are arranged to inject fuel into the tubular catalytic combustion chambers 22 to the space between the first catalytic combustion zone, the first catalyst coated honeycomb monolith 30 and the second catalytic combustion zone, the second catalyst coated honeycomb monolith 32. The fuel supply is arranged to supply the fuel to the second fuel injectors 46 Via the fuel pump 40, the fuel pipe 42 and a valve or valves 48. It may be necessary to provide mixing devices to ensure that there is intimate mixing of the fuel and air before before the fuel reaches the second catalytic combustion zone 32.

The fuel supply 36 may also be arranged to supply fuel to a plurality of third fuel injectors 50. There may be more than one third fuel injector 50 for each tubular combustion chamber 22. The third fuel injectors 50 are arranged to inject fuel into the tubular catalytic combustion chambers 22 to the space between the second catalytic combustion zone, the second catalyst coated honeycomb monolith 32 and the third catalytic combustion zone, the third catalyst coated honeycomb monolith 34. The fuel supply is arranged to supply the fuel to the third fuel injectors 50 via the fuel pump 40, the fuel pipe 42 and a valve or valves 52. It may be necessary to provide mixing devices to ensure that there is intimate mixing of the fuel and air before before the fuel reaches the third catalytic combustion zone 34.

In operation in a first mode of operation, at start up and at powers up to a predetermined power, the valve, or valves, 44 are opened and fuel is supplied from the fuel supply 36 to the first fuel injectors 38 such that substantially all the fuel is supplied from the first fuel injectors 38 into the catalytic combustion chambers 22 upstream of the first catalytic combustion zone 30. The fuel is burnt in the first catalytic combustion zone 30 to produce heat to heat the second and third catalytic combustion zones 32 and 34 up to the required temperature range for the selected catalysts. Any unburned fuel leaving the first catalytic combustion zone 30 is burnt in the second catalytic combustion zone 32 or in the second catalytic combustion zone 32 and the third catalytic combustion zone 34. Whatever fuel remains on leaving the third, or last, catalytic combustion zone 34 is then burnt in a homogeneous combustion zone 54 which produces minimal levels of NOx. For example as the fuel supply is increased from say idle power to 4% power substantially all the fuel is supplied to the first fuel injectors 38 and no fuel is supplied to the second fuel injectors 46, or the third fuel injectors 50.

In the second mode of operation, at powers above the predetermined power, the valve, or valves, 44 are completely closed to terminate the supply of fuel to the first fuel injectors 38 and the valve, or valves, 48 are opened and fuel is supplied from the fuel supply 36 to the second fuel injectors 46 such that all the fuel is supplied from the second fuel injectors 46 into the catalytic combustion chambers 22 between the first catalytic combustion zone 30 and the second catalytic combustion zone 32. Thus in the second mode of operation no fuel is supplied to the first catalytic combustion zone 30, and thus the first catalytic combustion zone 30 does not become overheated at high power operation, and also the second and third catalytic combustion zones 32 and 34 respectively may not become overheated. Furthermore this enables the catalyst in the first catalytic combustion zone 30 to be optimised for lower temperature capabilities without fear of being overheated.

Alternatively in the second mode of operation, at powers above the predetermined power, the valve, or valves, 44 are partially closed to reduce the supply of fuel to the first fuel injectors 38 and the valve, or valves, 48 are opened and fuel is supplied from the fuel supply 36 to the second fuel injectors 46 such that most of the fuel is supplied from the second fuel injectors 46 into the catalytic combustion chambers 22 between the first catalytic combustion zone 30 and the second catalytic combustion zone 32. Thus in the second mode of operation only a small amount of fuel, for example up to 10%, is supplied to the first catalytic combustion zone 30, and thus the first catalytic combustion zone 30 and does not become overheated at high power operation, and the second and third catalytic combustion zones 32 and 34 may not become overheated. Furthermore this enables the catalyst in the first catalytic combustion zone 30 to be optimised for lower temperature capabilities without fear of being overheated.

For example at powers above 40% power the valve 48 is opened to gradually increase the supply rate of fuel to the second fuel injectors 46 and the supply rate of fuel to the first fuel injectors 38 increases transiently while combustion in the catalytic combustion chamber 22 stabilises. Thereafter the valve 44 is either partially or fully closed to reduce the supply rate, or terminate the supply, of fuel to the first fuel injectors 38.

It is also possible in a third mode of operation at very high powers to open the valve, or valves, 52 such that some additional fuel is supplied to the third fuel injectors 50. It may be possible at very high powers to close or partially close the valve, or valves 48 to terminate or reduce the supply rate of fuel to the second fuel injectors 46 and the valve, or valves, 52 are opened and fuel is supplied from the fuel supply 36 to the third fuel injectors 50 such that some of the fuel is supplied from the third fuel injectors 50 into the catalytic combustion chambers 22 between the second catalytic combustion zone 32 and the third catalytic combustion zone 34. By partially opening the valves 52 it provides a method of controlling the catalytic combustion process such that the temperatures of each of the catalysts does not exceed the value which may cause damage to the catalysts and intermediate power levels may be achieved.

The aim of the catalytic combustion chamber is to achieve a sufficiently high temperature downstream of the last catalytic combustion zone such that homogeneous gas phase reactions are maintained in the homogeneous gas phase combustion zone 54.

The present invention has been described with reference to catalytic combustion zones comprising catalyst coated honeycomb monoliths. It is possible to use catalytic combustion zones comprising catalyst coated metallic honeycomb matrix, for example a metallic matrix comprising one or more corrugated metal strips interleaved with one or more smooth metal strips which are wound into a spiral or are arranged concentrically. A suitable metal for forming the metallic matrix is an iron-chromium-aluminium alloy which may contain yttrium for example FeCrAlloy (Registered Trade Mark). It is also possible to use catalytic combustion zones comprising honeycomb monoliths formed from catalyst material or honeycomb monoliths containing catalyst material. It is also possible to use catalytic combustion zones comprising catalyst coated ceramic honeycomb monoliths.

It may also be possible to provide a pilot combustor 56 upstream of the first catalytic combustion zone 30 to preheat the first catalytic combustion zone 30 up to its operating temperature range, as is shown in FIG. 2. If a pilot combustor is provided, then in the first mode of operation, a small portion of the total fuel supplied to the combustion chamber is supplied to the pilot combustor. Alternatively other heating devices may be provided to preheat the first catalytic combustion zone up to the required operating temperature range, for example a heat exchanger may be used to heat the air supplied to the first catalytic combustion zone.

The invention is applicable to tubular, annular or other types of combustion chamber.

It may be possible to use a single valve to control the flow of fuel to the first and second fuel injectors, rather than two valves as described.

It may be possible to only have the first and second catalytic combustion zones, or only to supply fuel to the first and second fuel injectors and possibly the pilot combustor. Although fuel pumps have been used in the description, it may not be necessary to provide fuel pumps to supply the fuel from the fuel supply to the fuel injectors.

It may be possible to arrange that the catalysts on the first and second catalytic combustion zones have substantially the same operating temperature range.

We claim:

1. A method of operating a catalytic combustion chamber, the catalytic combustion chamber comprising a first catalytic combustion zone and a second catalytic combustion zone spaced from and positioned downstream of the first catalytic combustion zone, means to supply air to the first catalytic combustion zone, means to supply fuel to the first catalytic combustion zone, means to supply fuel to the space between the first and second catalytic combustion zones, a pilot combustor upstream of the first catalytic combustion zone and means to supply air and fuel to the pilot combustor zone, the method comprising:

a) supplying fuel to the pilot combustor to preheat the first catalytic combustion zone to a required operating temperature range in a first mode of operation, b) supplying substantially all of the fuel to the first catalytic combustion zone in a second mode of operation, c) reducing the supply of fuel to the first catalytic combustion zone and supplying fuel to the space between the first and second catalytic combustion zones in a third mode of operation.

2. A method of operating a catalytic combustion chamber, the catalytic combustion chamber comprising a first catalytic combustion zone, and at least a second catalytic combustion zone spaced from and positioned downstream of the first catalytic combustion zone, means to supply air to the first catalytic combustion zone, means to supply fuel to the first catalytic combustion zone and means to supply fuel to the space between the first and second catalytic combustion zones, a pilot combustor upstream of the first catalytic combustion zone and means to supply air and fuel to the pilot combustor, the method comprising:

(a) supplying fuel to the pilot combustor to preheat the first catalytic combustion zone to the required operating temperature range in a first mode of operation, (b) supplying substantially all the fuel to the first catalytic combustion zone in a second mode of operation for all power levels up to a predetermined power, (c) supplying substantially all the fuel to the space between the first and second catalytic combustion zones and reducing the supply of fuel to the first catalytic combustion zone to at most a small amount in a third mode of operation for all power levels above the predetermined power to minimize overheating of the first catalytic combustion zone.

3. A method of operating a catalytic combustion chamber, the catalytic combustion chamber comprising a first catalytic combustion zone, a second catalytic combustion zone spaced from and positioned downstream of the first catalytic combustion zone, a third catalytic combustion zone spaced from and positioned downstream of the second catalytic combustion zone, means to supply air to the first catalytic combustion zone, means to supply fuel to the first catalytic combustion, means to supply fuel to the space between the first and second catalytic combustion zones and means to supply fuel to the space between the second and third catalytic combustion zones, the method comprising:

(a) supplying substantially all the fuel to the first catalytic combustion zone in a first mode of operation for all power levels up to a predetermined power, (b) supplying substantially all the fuel to the space between the first and second catalytic combustion zones and reducing the supply of fuel to the first catalytic combustion zone to at most a small amount in a second mode of operation for all power levels above the first predetermined power up to a second predetermined power to minimize overheating of the first catalytic combustion zone, (c) supplying substantially all the fuel to the space between the second and third catalytic combustion zones, reducing the supply of fuel to the space between the first and second catalytic combustion zones to at most a small amount of fuel supplied to the first catalytic combustion zone in a third mode of operation for all power levels above the second predetermined power to minimize overheating of the first and second catalytic combustion zones.

4. A method as claimed in claim 3 wherein in step (b) the supply of fuel to the first catalytic combustion zone is reduced to 10% or less of the total fuel supplied to the combustion chamber and 90% or more of the total fuel supplied to the combustion chamber is supplied to the space between the first and second catalytic combustion zones.

5. A method as claimed in claim 4 wherein in step (b), the supply of fuel to the first catalytic combustion zone is terminated and all the fuel is supplied to the space between the first and second catalytic combustion zones.

6. A method as claimed in claim 3 wherein the first catalytic combustion zone comprises a catalyst suitable for catalyzing combustion reactions at a first temperature range, the second catalytic combustion zone comprises a catalyst suitable for catalyzing combustion reactions at a second temperature range and the third catalytic combustion zone comprises a catalyst suitable for catalyzing combustion reactions at a third temperature range, the first temperature range being at lower temperatures than the second temperature range and the second temperature range being lower than the third temperature range.

7. A method as claimed in claim 3 wherein the first catalytic combustion zone comprises a catalyst suitable for catalyzing combustion reactions at a first temperature range, the second catalytic combustion zone comprises a catalyst suitable for catalyzing combustion reactions at a second temperature range and the third catalytic combustion zone comprises a catalyst suitable for catalyzing combustion reactions at a third temperature range, the first temperature range being substantially the same as the second temperature range and the second temperature range being lower than the third temperature range.

* * * * *